US010890174B2

(12) United States Patent
Cronbaugh

(10) Patent No.: US 10,890,174 B2
(45) Date of Patent: Jan. 12, 2021

(54) HYDROSTATIC SYSTEM PROVIDING VOLUMETRIC EFFICIENCY WHEN PUMP IS NEUTRAL

(71) Applicant: Danfoss Power Solutions Inc., Ames, IA (US)

(72) Inventor: Joshua Cronbaugh, Ames, IA (US)

(73) Assignee: Danfoss Power Solutions Inc., Ames, IA (US)

( * ) Notice: Subject to any disclaimer, the term of this patent is extended or adjusted under 35 U.S.C. 154(b) by 64 days.

(21) Appl. No.: 16/217,159

(22) Filed: Dec. 12, 2018

(65) Prior Publication Data

US 2020/0191138 A1 Jun. 18, 2020

(51) Int. Cl.

| | |
|---|---|
| ***F04B 49/08*** | (2006.01) |
| ***F04B 49/24*** | (2006.01) |
| ***F04B 49/035*** | (2006.01) |
| ***F04B 49/02*** | (2006.01) |

(52) U.S. Cl.

CPC ..... *F04B 49/08* (2013.01); *F04B 49/022* (2013.01); *F04B 49/035* (2013.01); *F04B 49/24* (2013.01)

(58) Field of Classification Search

CPC ..... F04B 49/035; F04B 49/24; F04B 49/022; F04B 49/08; F04B 1/08; F04B 49/03; F04B 49/22

See application file for complete search history.

(56) References Cited

U.S. PATENT DOCUMENTS

| | | | | |
|---|---|---|---|---|
| 3,753,627 | A * | 8/1973 | Ward | F04B 1/324 417/213 |
| 2018/0354485 | A1* | 12/2018 | Adeeb | B60T 13/16 |
| 2018/0372087 | A1* | 12/2018 | Hebrard | F04B 35/04 |

FOREIGN PATENT DOCUMENTS

WO WO2017129553 * 8/2017

* cited by examiner

*Primary Examiner* — Bryan M Lettman
(74) *Attorney, Agent, or Firm* — Zarley Law Firm, P.L.C.

(57) ABSTRACT

A hydrostatic system that provides different volumetric efficiency at different states and includes a pump with a discharge and supply line. Connected between the discharge and supply line is a valve. The valve is adapted to move to a position having a cross port orifice when the pump is in a neutral state and a position where the ports are blocked when the pump is in an operation state.

15 Claims, 1 Drawing Sheet

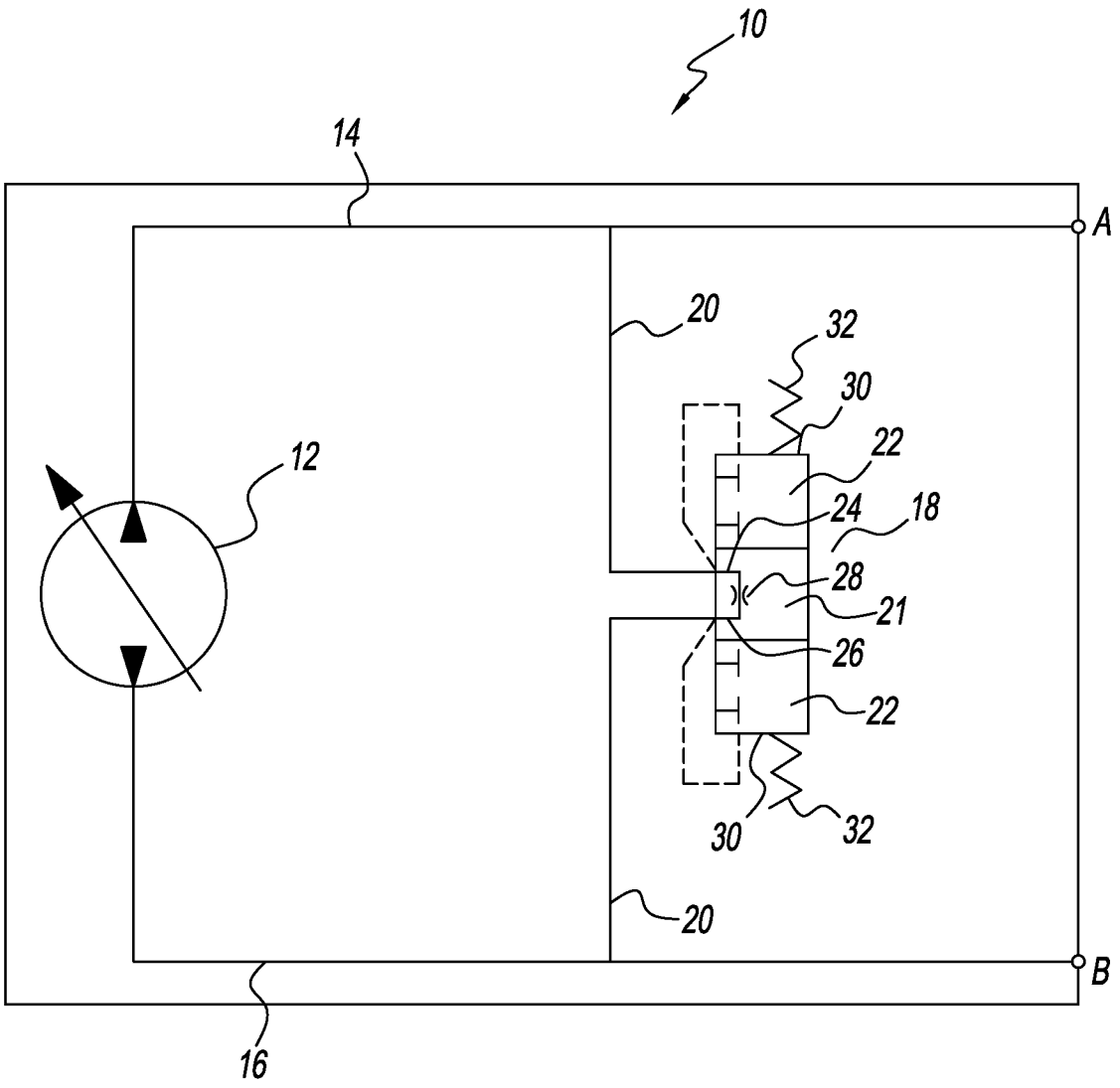
10
14
A
20
32
30
22
12
24
18
28
21
26
22
30
32
20
B
16

HYDROSTATIC SYSTEM PROVIDING VOLUMETRIC EFFICIENCY WHEN PUMP IS NEUTRAL

BACKGROUND OF THE INVENTION

This invention is directed to a hydrostatic system that has different volumetric efficiency when a pump is in a low pressure neutral state as compared to a high pressure operational state.

Recent design changes to rotating kits and valve plates have resulted in improvements in volumetric efficiency for hydrostatic systems. While beneficial, improved volumetric efficiency have created problems in order to adjust mechanical neutral of the pump. The mechanical tolerances of the pumps control servo system are compensated by the rotating kit's leakage. Thus, when the rotating kit's volumetric efficiency increases, the control system's tolerances need to decrease. With present systems, this relationship limits how much volumetric efficiency can be improved. Accordingly, there is a need in the art for a system that addresses these deficiencies.

An objective of the present invention is to provide a hydrostatic system that permits greater volumetric efficiencies based on the mechanical tolerances of the pump.

Another objective of the present invention is to provide a hydrostatic system that has different volumetric efficiency when a pump is in a neutral state versus an operational state.

These and other objectives will be apparent to those having ordinary skill in the art based upon the following written description, drawing, and claims.

SUMMARY OF THE INVENTION

A hydrostatic system having different volumetric efficiency at different pressure differential includes a pump having a discharge and a supply conduit. Connected between the discharge and supply conduits is a valve.

The valve has multiple positions and is adapted to move to a position having a cross port orifice when the pump is in a neutral state where the port pressure differential is within an allowed range. The valve is also adapted to move the valve to a position where the ports are blocked when the pump is in an operational state and the port pressure differential falls outside the allowed range.

BRIEF DESCRIPTION OF THE DRAWING

The FIGURE is a schematic view of a partial hydrostatic system.

DETAILED DESCRIPTION OF THE PREFERRED EMBODIMENTS

Referring to the FIGURE, a closed circuit hydrostatic system 10 includes a pump 12 having a discharge line or conduit 14 and a supply line or conduit 16. Preferably, the pump 12 is a variable displacement axial piston pump.

A valve 18 is connected between, and in fluid communication with, the discharge and supply lines 14 and 16 by line or conduit 20. Preferably, the valve 18 is a three position spool valve having a center position 21 and a pair of end positions 22. Each position 21 and 22 has an input port 24 and an output port 26. The center position 21 has a cross port orifice 28, while the end positions block the connection between ports 24 and 26.

Each end 30 of the valve 18 has a spring 32 that is piloted to the ports 24 and 26 of the positions 21 and 22 based upon the port pressure differential. The port pressure differential is used to determine when the pump is in a neutral or operational position. The pump 12 has an allowed port pressure differential which is based upon the designed or determined shuttle pilot pressure. Further, the size of the cross port orifice 28 is determined by the required volumetric efficiency leakage at the pilot pressure differential to offset the mechanical neutral tolerances.

In operation, when the allowed port pressure differential is present and the pump is in neutral, the valve 18 is in the center position 21 permitting flow through the input port 24 to the output port 26 through the cross port orifice 28. When there is a port pressure differential greater than the allowed port pressure differential the springs 32 on the ends 30 of the valve 18 are piloted so that the valve 18 shifts from the center position 21 to an end position 22 where there is no cross port and flow is blocked.

What is claimed is:

1. A hydrostatic system, comprising:

a pump with a discharge conduit and a supply conduit, wherein the discharge conduit and the supply conduit are outside the pump; and a valve connected between the discharge conduit and the supply conduit;

wherein the valve is adapted to selectively move to a position having a cross port orifice when the pump is in neutral allowing a flow between the discharge conduit and the supply conduit, and a pair of end positions that each block a connection between the discharge conduit and the supply conduit.

2. The system of claim 1 wherein the pump is a variable displacement axial piston pump.

3. The system of claim 1 wherein the valve is a three position spool valve with a center position having the cross port orifice.

4. The system of claim 1 wherein each end of the valve has a spring and piloted connection that selectively moves the valve based upon port differential.

5. The system of claim 1 wherein the pump is in neutral when a port pressure differential is within an allowed range determined by a shuttle pilot pressure.

6. The system of claim 1 wherein a size of the cross port orifice is determined by a volumetric efficiency leakage at a pilot pressure differential to offset mechanical neutral tolerances of the pump.

7. A hydrostatic system, comprising:

a pump having a discharge conduit and a supply conduit;

a three position spool valve having a center position and a pair of end positions;

the center position having a cross port orifice configured to permit a flow between the discharge conduit and the supply conduit; and the pair of end positions configured to block a flow between the discharge conduit and the supply conduit;

wherein the discharge conduit and the supply conduit are outside the pump.

8. The system of claim 7 further comprising the center position and the pair of end positions each having an input port and an outlet port.

9. The system of claim 7 further comprising the center position having an input port and an outlet positioned on a same side of the three position spool valve.

10. The system of claim 7 wherein the three position spool valve is in the central position when an allowed port pressure differential is present.

11. The system of claim 7 wherein the three position spool valve is in one of the pair of end positions when a port pressure differential exceeds the allowed port pressure differential.

12. The system of claim 7 further comprising a first spring and a second spring on opposing ends of the three position spool valve, wherein when a port pressure differential exceeds an allowed port pressure differential one of the first spring and the second spring are piloted to shift to one of the pair of end positions thereby blocking flow between the discharge conduit and the supply conduit.

13. A hydrostatic system, comprising:

a pump having a discharge conduit and a supply conduit; and a valve having a center position and a pair of end positions;

wherein the valve is in a central position when an allowed port pressure differential is present and in one of the pair of end positions when a port pressure differential exceeds the allowed port pressure differential;

wherein the pair of end positions block flow between the discharge conduit and the supply conduit;

wherein the discharge conduit and the supply conduit are outside the pump.

14. The system of claim 13 further comprising the center position and the pair of end positions each having an input port and an outlet port.

15. The system of claim 13 further comprising the center position having an input port and an outlet positioned on the same side of the valve.

* * * * *